United States Patent [19]

Anacker

[11] 3,949,434

[45] Apr. 13, 1976

[54] DUAL PURPOSE SOFA BED

[76] Inventor: Charles D. Anacker, 502 Frenchman St., New Orleans, La. 70116

[22] Filed: Nov. 27, 1974

[21] Appl. No.: 527,814

[52] U.S. Cl. ..... 5/12 R; 5/37 R; 5/110

[51] Int. Cl.[2] ..... A47C 17/14

[58] Field of Search ..... 5/12, 13, 37 R, 38, 43, 5/45, 46, 110, 114; 297/118

[56] References Cited

UNITED STATES PATENTS

| | | | |
|---|---|---|---|
| 2,992,442 | 7/1961 | Lehman et al. | 5/114 |
| 3,329,977 | 7/1967 | Heller | 5/37 R |
| 3,377,635 | 4/1968 | Schindler | 5/45 |

FOREIGN PATENTS OR APPLICATIONS

| | | | |
|---|---|---|---|
| 168,021 | 9/1950 | Austria | 5/37 R |

*Primary Examiner*—Casmir A. Nunberg
*Attorney, Agent, or Firm*—William W. Haefliger

[57] ABSTRACT

A dual purpose sofa bed comprises a. first and second longitudinally elongated frame sections including longitudinally elongated, parallel tubular stretches two of which associated with the respective sections extend in adjacent relation, b. and hinge means interconnecting said two stretches to accommodate pivoting of the sections between collapsed and extended condition, one section overlying the other to form a sofa framework in said collapsed condition, and said sections extending at the same level to form a bed framework in said extended condition, c. said hinge means including longitudinally extending integral parallel sleeves respectively in alignment with said two stretches, and hinge pins received within said sleeves and stretches.

8 Claims, 7 Drawing Figures

10
11
12
13
14
15
16
18
19
23
24
25
26
27
30
31
32
33
34
36
38
39
40
41
42
43
44
45
46
47
48
72
73
74
131
133
135
137

75
15
11
74
72
73
34
41
19
50
40
36
14
13
32
39
17
38
30
12
10

41
44
43
36
47
48
25
23
27
46
26
24
45
32
33
34

13
14
25
24
26
27
36
21
23
22
32
47
5
5
45
24
46
25
48

11
14
13
36
32
70
39
41
19
20
17
40
38
74
34
30
71
73
15
12
72
10

DUAL PURPOSE SOFA BED

BACKGROUND OF THE INVENTION

This invention relates generally to furniture, and more particularly concerns sofa beds.

There is a continuing need for light-weight, low-cost sofa beds of simple construction enabling conversion between sofa and bed modes with minimum effort. No prior sofa-bed of which I am aware meets this need in the unusually advantageous manner as now afforded by the present invention.

SUMMARY OF THE INVENTION

Basically, the dual purpose sofa bed comprises:

a. first and second longitudinal elongated frame sections including longitudinally elongated, parallel tubular stretches two of which associated with the respective sections extend in adjacent relation, b. and hinge means interconnecting said two stretches to accommodate pivoting of the sections between collapsed and extended conditions, one section overlying the other to form a sofa framework in said collapsed condition, and said sections extending at the same level to form a bed framework in said extended condition, c. said hinge means including longitudinally extending integral parallel sleeves respectively in alignment with said two stretches, and hinge pins received within said sleeves and stretches.

As will appear, the arrangement may be such that in collapsed condition of the sections the longitudinal tubular stretches of the first section directly overlie the longitudinal tubular stretches of the second section to transmit loading thereto; also, relative horizontal displacement of the sections is then blocked.

Further, horizontally extending resilient supports are typically carried by the frame sections, as via generally rectangular tubular sub-frames rotatably connected to the hinge pins as will be seen; in addition, the sections may include U-shaped tubular stretches integral with the longitudinal stretches, to support the latter in bed and sofa modes.

These and other objects and advantages of the invention, as well as the details of an illustrative embodiment, will be more fully understood from the following description and drawings, in which:

DRAWING DESCRIPTION

DETAILED DESCRIPTION

Figures 1, 6, 7:
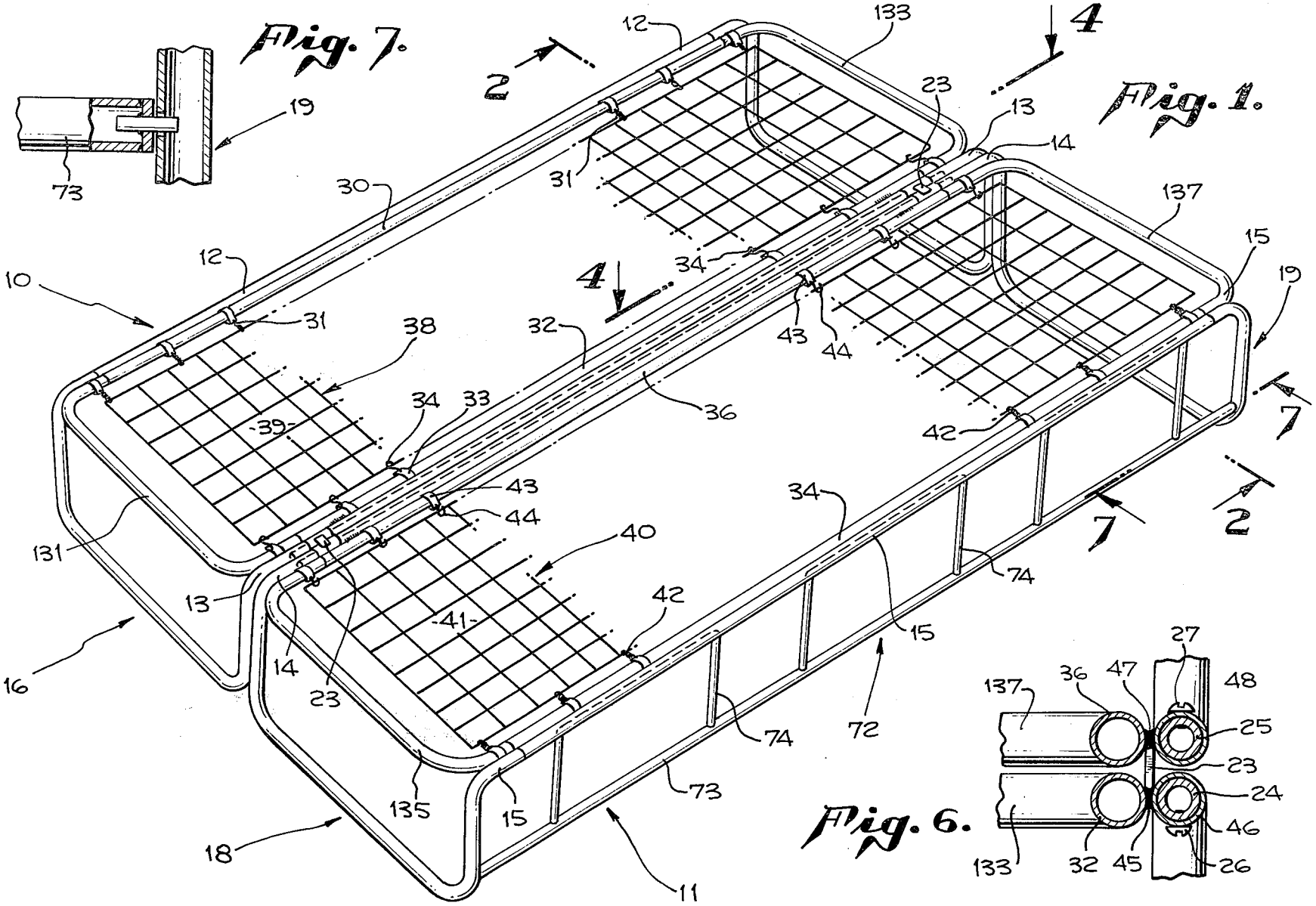
FIG. 1 is a perspective showing of one preferred embodiment of the invention, in bed configuration.
FIG. 6 is a view like FIG. 5, but showing the hinge in sofa configuration.
FIG. 7 is an enlarged vertical section on lines 7—7 of FIG. 1.

In the drawings, first and second longitudinally elongated frame sections are shown at 10 and 11, and as including longitudinally elongated, parallel tubular stretches 12–15. Two of the stretches, i.e. 13 and 14, extend in closely adjacent parallel relation. Each section includes first and section U-shaped tubular stretches integral with two of the longitudinal tubular stretches at opposite ends thereof. For example, section 10 includes U-shaped tubular stretches 16 and 17 respectively integral with opposite ends of longitudinal stretches 12 and 13, and section 11 includes U-shaped tubular stretches 18 and 19 integral with opposite ends of longitudinal stretches 14 and 15.

Figure 3:
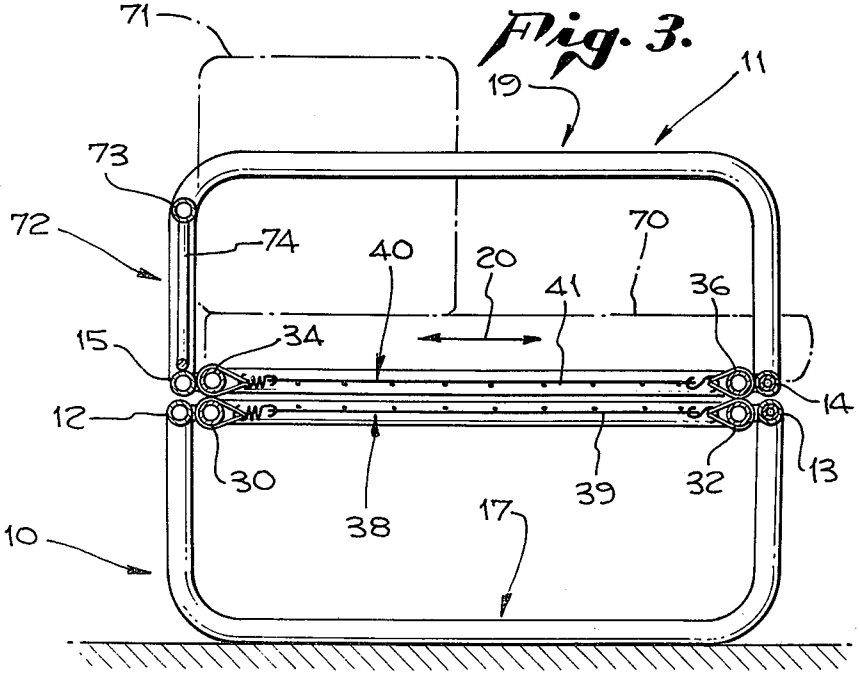
FIG. 3 is a view like FIG. 2 showing the embodiment in sofa configuration.

In FIG. 1, bed mode, all the U-shaped tubular stretches extend downwardly to act as supports for the sections; whereas, in FIG. 3 sofa mode, U-shaped stretches 18 and 19 extend upwardly to act as sofa ends or arm rests, and U-shaped stretches 16 and 17 continue to project downwardly to act as sofa supports.

Hinge means is provided to interconnect the two adjacent longitudinal stretches 13 and 14 to accommodate pivoting of the sections between collapsed (FIG. 3) and extended (FIG. 1) condition or position. Note that in FIG. 3, stretches 12 and 13 respectively overlie and transmit loading to stretches 15 and 14, respectively, as accommodated by the hinge means, the latter also resisting displacement of the upper section relative to the latter in lateral directions indicated by arrows 20.

Figure 5:
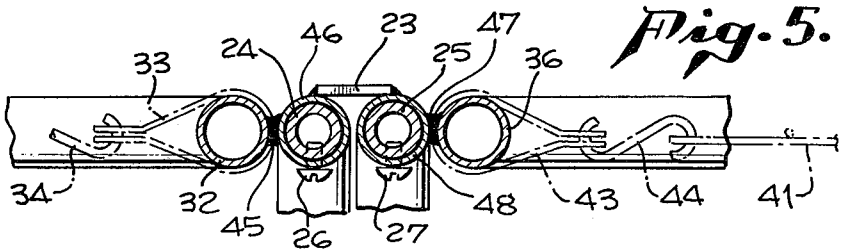
FIG. 5 is a section on lines 5—5 of FIG. 4.
Figure 4:
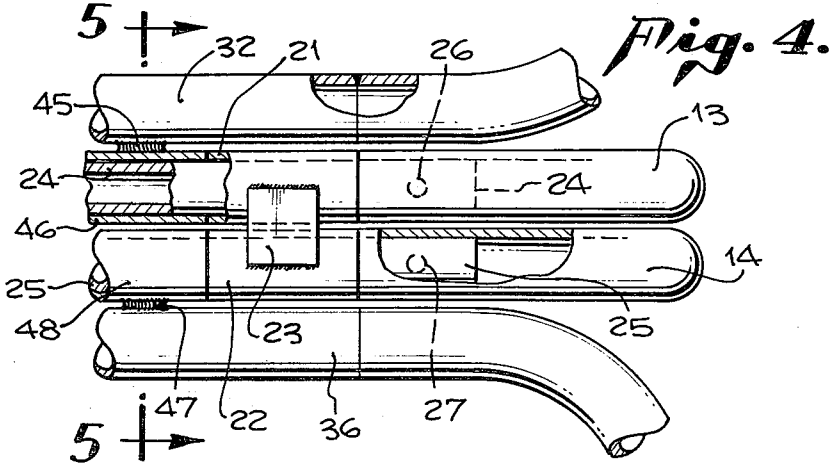
FIG. 4 is an enlarged fragmentary plan view on line 4—4 of FIG. 1, and showing hinge construction.

As seen in FIGS. 4–6, the hinge means includes short, longitudinally extending sleeves 21 and 22 which are integrally interconnected as by tabs 23. Sleeve 21 is in coaxial alignment with stretch 13, and sleeve 22 is in coaxial alignment with stretch 14. In addition, hinge pin 24 is coaxially received in sleeve 21 and stretch 13, whereas hinge pin 25 is coaxially received in sleeve 22 and strech 14. Fastener 26 attaches pin 24 to stretch 13, and fastener 27 attaches pin 25 to stretch 14.

Each section 10 and 11 includes a generally rectangular sub-frame carrying a horizontally extending resilient support; thus, for example, section 10 includes a first sub-frame defined by tubular stretches 130–133 extending in a loop, and section 11 includes a second sub-frame defined by tubular stretches 134–137 extending in a loop. Resilient support 38 carried by the first sub-frame includes a wire mesh 39 connected to stretch 30 by tension springs 31, and to stretch 32 by loop straps 33 and hooks 34. Similarly, resilient support 40 carried by the second sub-frame includes a wire mesh 41 connected to stretch 34 by springs 42 and to stretch 36 by loop straps 43 and hooks 44.

Figure 2:
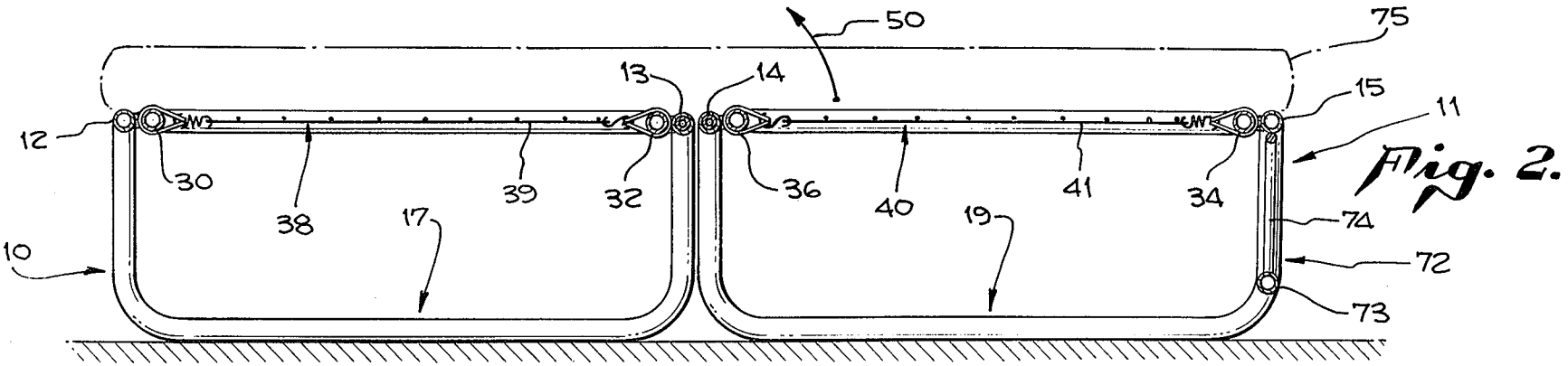
FIG. 2 is a vertical section on lines 2—2 of FIG. 1.

Sub-frame longitudinal stretch 32 is attached at 45 to a secondary sleeve 46 coaxial with primary sleeve 21 so as to also receive pin 24; likewise, sub-frame longitudinal stretch 36 is attached at 47 to a secondary sleeve 48 coaxial with primary sleeve 23 so as to also receive pin 25. As a result, when the frame section 11 is rotated in the direction of arrow 50 in FIG. 2 to collapsed condition as seen in FIG. 3, the primary sleeves 21 and 22 first rotate about the axis of pin 24 to vertical condition, and thereafter, stretch 36 and integral sleeve 48 rotate about the axis of pin 25 to complete the 180° rotation of stretch 36, and also stretch 14 connected thereto.

Sofa pillows or pads are shown at 70 and 71 in FIG. 3. Pillow 71 rests against frame back rest 72 better seen in FIG. 1 as including longitudinal tubing 73 joined to U-shaped stretches 18 and 19, and vertical tubings 74. A bed mattress appears at 75 in FIG. 2.

I claim:

1. In a dual purpose sofa bed, the combination comprising a. first and second longitudinally elongated frame sections including longitudinally elongated, parallel tubular stretches two of which associated with the respective sections extend in adjacent relation, b. and hinge means interconnecting said two stretches to accommodate pivoting of the sections between collapsed and extended condition, one section overlying the other to form a sofa framework in said collapsed condition, and said sections extending at the same level to form a bed framework in said extended condition, c. said hinge means including longitudinally extending integral parallel sleeves respectively in alignment with said two stretches, and hinge pins received within said sleeves and stretches, d. the longitudinal tubular stretches of the first section directly overlying the longitudinal tubular stretches of the second section in said collapsed condition of the sections, the hinge means then resisting relative horizontal displacement of the first section relative to the second section.

2. The combination of claim 1 including horizontally extending resilient supports carried by said frame sections.

3. The combination of claim 2 wherein each section includes a generally rectangular tubular sub-frame carrying one of said resilient supports.

4. The combination of claim 1 wherein each of said sections includes U-shaped tubular stretches integral with two of the longitudinal stretches at opposite ends thereof, said U-shaped sections extending downwardly in said extended condition of the sections.

5. The combination of claim 4 wherein two of said U-shaped stretches associated with said one section extend upwardly in said collapsed condition of the sections.

6. In a dual purpose sofa bed, the combination comprising a. first and second longitudinally elongated frame sections including longitudinally elongated, parallel tubular stretches two of which associated with the respective sections extend in adjacent relation, b. and hinge means interconnecting said two stretches to accommodate pivoting of the sections between collapsed and extended condition, one section overlying the other to form a sofa framework in said collapsed condition, and said sections extending at the same level to form a bed framework in said extended condition, c. said hinge means including longitudinally extending integral parallel sleeves respectively in alignment with said two stretches, and hinge pins received within said sleeves and stretches, d. there being horizontally extending resilient supports carried by said frame sections, each section including a generally rectangular tubular sub-frame carrying one of said resilient supports, each sub-frame including a longitudinal stretch adjacent one of said two stretches, each sub-frame stretch rotatably connected to one of said pins via a secondary sleeve coaxial with one of said first mentioned sleeves.

7. The combination of claim 1 including tab means interconnecting said sleeves externally thereof, the tab means extending generally vertically in said collapsed condition.

8. The combination of claim 7 wherein each frame includes a tubular sub-frame, the sub-frames including longitudinal stretches which extend adjacent said tab means and at the side thereof generally opposite said sleeves in said collapsed condition.

* * * * *